United States Patent [19]

Coy et al.

[11] Patent Number: 4,554,697

[45] Date of Patent: Nov. 26, 1985

[54] BALLAST BROOMS

[75] Inventors: Calvin L. Coy, Chapin; Keith T. O'Neal, Columbia, both of S.C.

[73] Assignee: Canron Corp., West Columbia, S.C.

[21] Appl. No.: 552,244

[22] Filed: Nov. 16, 1983

[51] Int. Cl.[4] ..... E01H 8/10

[52] U.S. Cl. ..... 15/55

[58] Field of Search ..... 15/55, 54, 83, 84, 82; 104/279; 37/209, 210; 134/6

[56] References Cited

U.S. PATENT DOCUMENTS

| | | | |
|---|---|---|---|
| 791,150 | 5/1905 | Huff | 15/55 |
| 2,777,220 | 1/1957 | Bates | 15/55 |
| 3,391,025 | 7/1968 | Foxx et al. | 104/279 X |

*Primary Examiner*—Edward L. Roberts

*Attorney, Agent, or Firm*—Wenderoth, Lind & Ponack

[57] ABSTRACT

There is described a self-propelled railroad track ballast broom machine having a first broom unit operatively mounted at the rear of the machine frame and a second broom unit operatively mounted at the front of the frame. The broom units have substantially cylindrical brooms extending transversely of the railroad track and deflector boxes located forwardly of each of the brooms. The brooms have gaps sufficiently wide, and so spaced apart thereon, as to avoid broom contact with the rail heads in normal tangent track sweeping operations. When the machine enters into track curves, the first broom unit is so far behind the machine rear axle that it is transversely displaced relative to the track center. Compensating transverse movement can be applied to the first broom unit to maintain the broom gaps in line with the rail heads and the ends of the broom in operative engagement with both the track shoulder edges.

3 Claims, 3 Drawing Figures

BALLAST BROOMS

The present invention relates to railway track ballast brooms.

Railway track brooms are used extensively on railroad tracks to sweep excess ballast, say deposited in a track lifting operation, from the tie tops into the cribs between the ties and to level the tops of the track shoulders. The operation keeps the spaces between the ties filled with excess ballast and in so doing removes excess ballast thereby preventing it from being sucked into the path of a fast moving train. In order to increase the productivity of railway ballast brooms they have, of late been attached to either end or both ends of a machine frame or power module. The brooms, which are generally cylindrical in configuration and are mounted transversely of the track so as to span it, normally require stone deflector shields in front of them to move the excess ballast from the center of the track to the shoulder area of the track structure. Clearly such deflectors require longitudinal space in front of the rotating brush and hence longitudinal space between at least one axle and the brush itself. This elongation of the working length of the machine creates problems for brooms remote from the machine's axles when the machine is operating in curves. Obviously the transverse displacement of a broom, relative to the track center on a long machine frame when it is passing through a curve, causes the outer extremeties of the transverse ballast broom to miss part of the shoulder ballast and possibly produce a wind-row effect.

It is common practice to allow a free space between rows of straws (bristles, elements of the broom) just as wide as the width of a rail, to prevent excessive damage of broom elements hitting the rail head constantly. However, when the machine is obliged to work in curved track, the broom elements normally adjacent to the rail are displaced transversely with respect to the track and now beat the steel rail head and consequently destroy themselves in a short while. This deficiency leads to frequent replacements which is costly both in labour, time, material and lost working time of the machine.

It has been proposed, in German patent document No. 2,928,198 to provide a system whereby the cylindrical track brooms are made up of transversely spaced concentric broom wheels individually mounted for vertical movement out of contact with the ballast. Thus, when a broom wheel encounters a rail, because of track curvature, that broom wheel is simply swung up out of the way while the other broom wheels making up the cylinder remain operative. The advantages of this arrangement are somewhat overshadowed by the complexity of the structure necessary to operatively mount such a multi-wheeled broom.

According to the present invention a railroad track ballast broom machine comprises a machine frame mounted on track wheels; a ballast broom operatively mounted on the frame; and means to translate the broom laterally of the frame.

Preferably the broom comprises a substantially cylindrical broom means mounted, in operation, to transversely span a railroad track. Conveniently the cylindrical broom means may have a pair of rail accommodating gaps dimensioned to clear a rail head, the gaps being spaced apart on the broom means by the dimension of a track rail gauge.

The broom means may be provided with a leading deflector box, the box and broom means being mounted on a broom unit, the broom unit, with its broom, being mounted for lateral movement on the machine frame.

The present invention also provides a railroad track ballast broom machine comprising a wheeled machine frame; a first broom unit operatively mounted on the frame and spaced rearwardly thereof; and a second broom unit operatively mounted on the frame forwardly thereof; said broom units including a substantially cylindrical broom means mounted in each unit so as, in operation, to transversely span the railroad track and a deflector box located forwardly of each broom means; and means to translate the first broom unit transversely of the machine frame.

The following is a description by way of example of one embodiment of the present invention reference being had to the accompanying drawings in which.

Turning now to the drawings.

A self-propelled ballast broom machine 10, has a machine frame 11 mounted on rail engaging sets of wheels 12 and 13, which are themselves mounted on axles.

Figure 1:
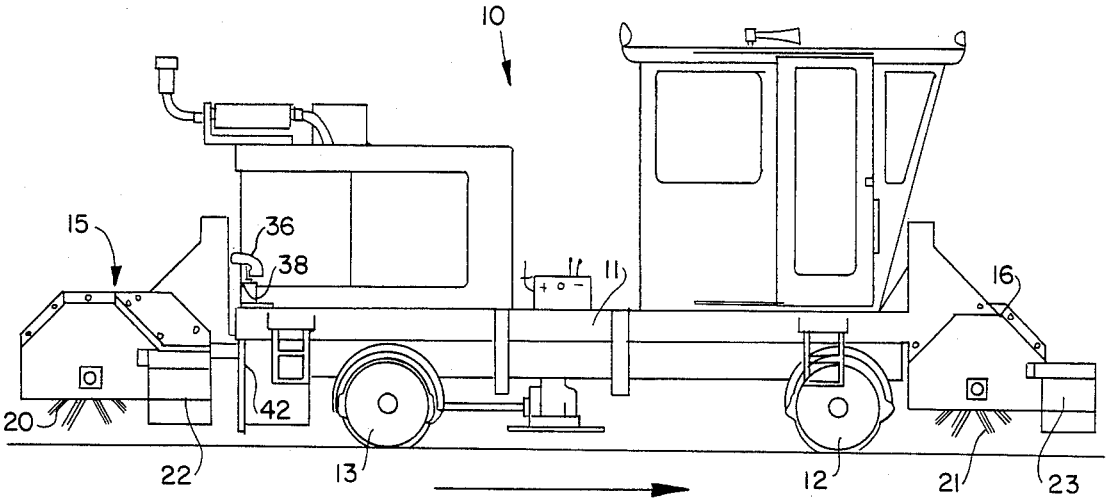
FIG. 1 is a side elevation of a double ballast broom machine.

The machine 10 has a first broom unit 15 and a second broom unit 16 mounted on the machine frame 11 at the rear and at the front of the machine respectively. The machine 10 moves in the direction of the arrow, from left to right, as shown in FIG. 1, when in operation.

Figure 3:
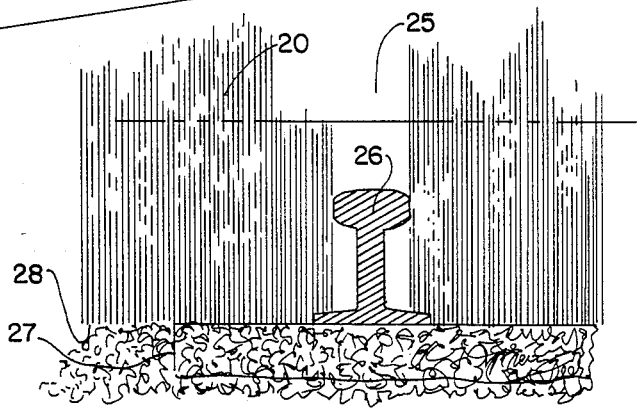
FIG. 3 is a detail of the broom in operation.

In each broom unit 15 and 16, there is provided a cylindrical broom 20, 21 of known configuration extending transversely of the machine frame 11 to span the track (see also FIG. 3).

The brooms 20 and 21 are driven in conventional fashion in a counterclockwise direction and the broom units 15 and 16 are each provided with a leading deflector box 22, 23 which act as stone deflector shields to move excess ballast from the center of the track to the shoulde area of the track structure.

The cylindrical brooms 20, 21 as shown are provided with two transversly spaced apart free spaces, or gaps, 25 at the point where the brooms 20, and 21 normally encounter each of the rails 26 (see FIG. 3) on tangent track. The cylindrical broom members 20 and 21 extend outwardly on each side beyond the tie ends 27 to the point 28 where the ballast shoulder starts to fall away from the upper plane of the track surface.

The second, or front ballast broom 16, may, in the configuration shown, be transversely fixed on the frame 11 because the broom 21 and its deflector 23 are close longitudinally to the axle of the front wheels 12. Thus when the machine 10 enters into a curve in the track, the broom 21, for all practical purposes, will follow the track. It is understood of course that the broom 21 and the front deflector box 23 can be raised and lowered on the frame 11 in usual fashion so as to be brought into operative contact with the ballast and to be lifted out of contact with the ballast, for track travel.

The first, or rear, broom unit 15, because of the dimensions of its deflector box and the fact that the broom unit 15 has to be mounted so as to overhang the rear of the machine, poses a problem. The broom 20 of the unit 15 is, as can be seen, spaced rearwardly by a substantial distance from the axles of the rear wheels 13 and because of this long frame effect, when the machine 10 enters into curves the rear broom unit 15 is displaced relative to the track center. This displaces the gaps 25 transversly relative to their rails. and the bristles (flails, etc.) laterally adjacent the gaps 25, starts to beat on the rail heads. Also, depending upon the sense of the track curve, one or other ballast shoulder edge 28 is not contacted by the broom and a wind-row of ballast may be formed along the top of the track adjacent that edge 28.

Figure 2:
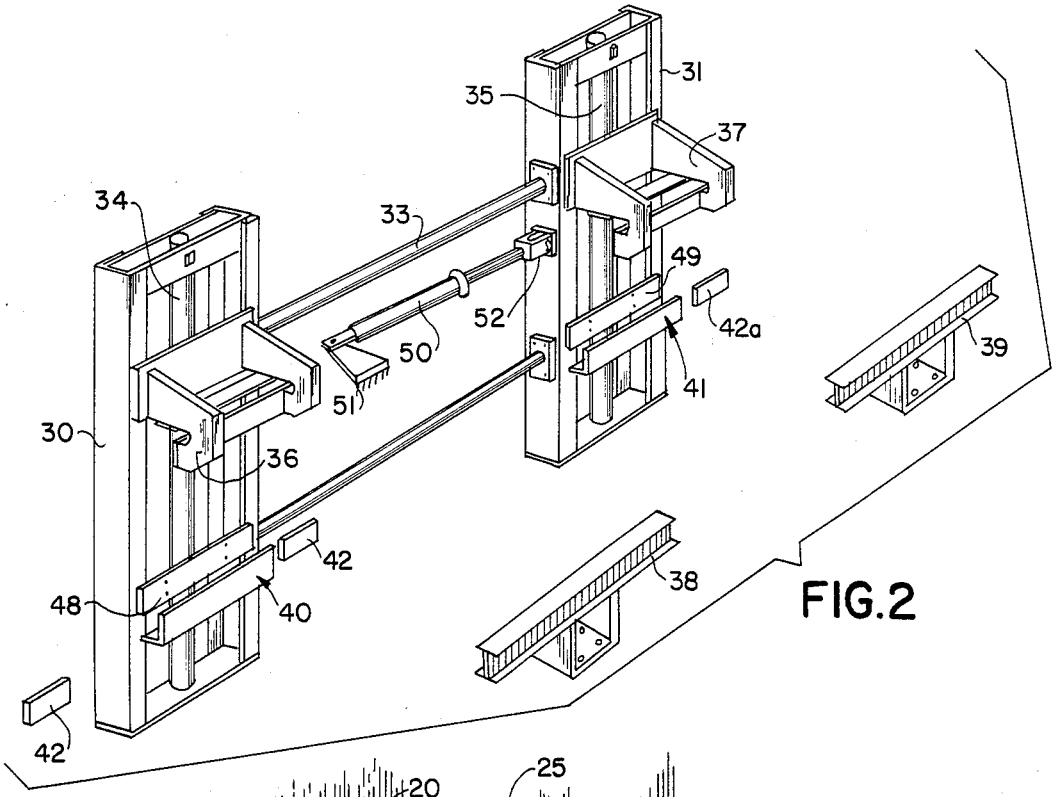
FIG. 2 is a detail of the broom unit mounting structure.

In order to overcome these shortcomings, the first broom unit 15 is mounted so that it may be compensatingly translated transversely relative to the frame 11 to maintain the broom 20 aligned with the ballast shoulder edges 28 and its spaced gaps 25 in line with the rail heads 26. To this end the rear broom unit 15 is provided with a couple of mounting subframes 30, 31 (see FIG. 2) which are connected by transverse struts 32, 33 and are provided with hydraulic lifting cylinders 34, 35 to raise and lower the first broom unit 15 into and out of operative engagement with the ballast. The subframes 30 and 31 have hook frames 36, 37 which engage over support girders 38, 39, welded or bolted to the rear of the machine frame 11, so that the subframes 30, 31 and the unit 15 which they support, may slide transversly of the frame 11 on girders 38, 39. Counterclockwise rocking of the broom unit 15 about the girders 38, 39 is prevented by pressure pad frames 40, 41 which essentially are angle iron members which engage about transverse plates 42, 42*a* (pictorially represented in FIG. 2 by the fragments displaced to the right or left of the pad frames 40, 41 which will engage them). Pressure pads 48, 49 complete the anti-rocking frames 40, 41.

A traversing cylinder 50 is welded to the frame 11 at 51 and is connected, at 52, to the right hand subframe 31. When hydraulic fluid is admitted into the cylinder 50, depending upon its direction of admitance, the subframes 30, 31 are displaced transversely of the track with the hook frames 36, 37 sliding on the girders 38, 39 and the pressure frames 40, 41, sliding relative to the plates 42, 42*a*. In this fashion the broom unit 15 is moved to the left or to the right transversely to the track. In order to be effective the distance of unit transverse movement need not be more than about 3 inches in either direction, in the configuration shown, and of course is a function of the distance of the rearward displacement of the broom 20 from the rear axle of the machine.

As the machine 10 moves into a track curve the rear broom unit 15 may be moved transversly relative to the track either manually by an operator, or automatically by providing sensors, to compensate for displacement relative to the track center. The gaps 25 can thus be maintained over the rail heads 26 and the broom elements adjacent the railheads continue to lie on either side thereof. Furthermore, the external portions of the broom 20 (see FIG. 3) are maintained at the correct position with respect to the edges 28 of the ballast.

It is of course understood that if a configuration of a machine were desired which would displace the second broom unit 16 far forwardly of the front axle, similar arrangements could be provided to compensatingly translate the unit 16 relative to the track.

What we claim as our invention is:

1. A railroad track ballast broom machine comprising a wheeled machine frame; a first broom unit operatively mounted on said frame and spaced rearwardly thereof; a second broom unit operatively mounted on said frame forwardly thereof; said broom units including a substantially cylindrical broom means mounted in each unit so as, in operation, to transversely span the railroad track and a deflector box located forwardly of each said broom means; and means to translate said first broom unit transversely of said machine frame.

2. Apparatus as claimed in claim 1 in which each broom means has a pair of rail accommodating gaps dimensioned to clear a rail head, said gaps being spaced apart on said broom means by the dimension of a track rail gauge.

3. A railroad track ballast broom machine comprising a machine frame mounted on track wheels; a ballast broom operatively mounted to said frame and spaced from one end thereof; and means located longitudinally between said machine frame and said broom to translate said broom laterally of said frame, said broom comprising a substantially cylindrical broom means mounted, in operation, to transversely span a railroad track and having a pair of rail accommodating gaps dimensioned to clear a rail head, said gaps being spaced apart on said broom means by the dimension of a track rail gauge.

* * * * *